US008099009B2

(12) United States Patent
Young et al.

(10) Patent No.: US 8,099,009 B2
(45) Date of Patent: Jan. 17, 2012

(54) METHOD FOR PRINT ENGINE SYNCHRONIZATION

(75) Inventors: Timothy J. Young, Williamson, NY (US); David J. Fuest, Warsaw, NY (US); Michael T. Dobbertin, Honeoye, NY (US); Christopher B. Liston, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 664 days.

(21) Appl. No.: 12/126,192

(22) Filed: May 23, 2008

(65) Prior Publication Data

US 2009/0290895 A1 Nov. 26, 2009

(51) Int. Cl.

| | |
|---|---|
| ***G03G 15/00*** | (2006.01) |
| ***G03G 15/22*** | (2006.01) |
| ***G03G 21/00*** | (2006.01) |

(52) U.S. Cl. ..... 399/75; 399/78

(58) Field of Classification Search ..... 399/75, 399/76, 78

See application file for complete search history.

(56) References Cited

U.S. PATENT DOCUMENTS

| | | | | |
|---|---|---|---|---|
| 4,591,884 | A | 5/1986 | Miyamoto et al. | |
| 4,609,279 | A | 9/1986 | Hausmann et al. | |
| 5,568,246 | A | 10/1996 | Keller et al. | |
| 5,963,770 | A | 10/1999 | Eakin | |
| 6,101,364 | A | 8/2000 | Bochmer et al. | |
| 6,219,516 | B1 | 4/2001 | Furst et al. | |
| 6,381,440 | B1 | 4/2002 | Bock et al. | |
| 6,477,950 | B1 | 11/2002 | Feilen et al. | |
| 6,786,149 | B1 | 9/2004 | Lomoine et al. | |
| 7,024,152 | B2 | 4/2006 | Lofthus et al. | |
| 7,076,200 | B2 | 7/2006 | Poletto | |
| 7,245,856 | B2 | 7/2007 | Furst et al. | |
| 7,310,108 | B2 | 12/2007 | Moore | |
| 7,519,314 | B2 * | 4/2009 | Carolan | 399/167 |
| 2003/0077095 | A1 * | 4/2003 | Conrow | 399/364 |
| 2003/0165349 | A1 | 9/2003 | Nakazawa | |
| 2006/0039015 | A1 | 2/2006 | Kageyama et al. | |
| 2006/0222418 | A1 | 10/2006 | Ebara et al. | |
| 2006/0233569 | A1 | 10/2006 | Furst et al. | |
| 2006/0285133 | A1 | 12/2006 | Sagi | |
| 2007/0122193 | A1 * | 5/2007 | Carolan | 399/167 |

FOREIGN PATENT DOCUMENTS

JP 11249527 A * 9/1999

* cited by examiner

*Primary Examiner* — David Gray
*Assistant Examiner* — Fred L Braun
(74) *Attorney, Agent, or Firm* — Donna P. Suchy

(57) ABSTRACT

A print engine synchronization method enables the movement of a first print engine dielectric support member (DSM) having one or more image frames as well as the movement of a second print engine DSM having one or more image frames by monitoring a first frame signal from the moving first print engine DSM and a second frame signal from the moving second print engine DSM. An offset is determined for each of corresponding pairs of frames from the one or more image frames of the first and second print engine DSM and the determined offset for each corresponding pair of frames is compared to a target offset to maintain synchronization between the first and second print engines on a frame by frame basis by adjusting a second print engine DSM velocity based on the comparison of the determined offset and the target offset.

22 Claims, 9 Drawing Sheets

METHOD FOR PRINT ENGINE SYNCHRONIZATION

CROSS REFERENCE TO RELATED APPLICATIONS

This application relates to commonly assigned, co-pending U.S. application Ser. No. 12/126,267, May 23, 2008, and entitled: "PRINT ENGINE SYNCHRONIZATION SYSTEM AND APPARATUS".

FIELD OF THE INVENTION

The claimed invention relates in general to imaging systems having more than one print engine, and more particularly to a system and method for print engine synchronization.

BACKGROUND OF THE INVENTION

In typical commercial reproduction apparatus (electrographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought directly, or indirectly via an intermediate transfer member, into contact with the dielectric support member, and an electric field is applied to transfer the marling particle developed image to the receiver member from the dielectric support member. After transfer, the receiver member bearing the transferred image is transported away from the dielectric support member, and the image is fixed (fused) to the receiver member by heat and/or pressure to form a permanent reproduction thereon.

A reproduction apparatus generally is designed to generate a specific number of prints per minute. For example, a printer may be able to generate 150 single-sided pages per minute (ppm) or approximately 75 double-sided pages per minute with an appropriate duplexing technology. Small upgrades in system throughput may be achievable in robust printing systems, however, the doubling of throughput speed is mainly unachievable without a) purchasing a second reproduction apparatus with throughput identical to the first so that the two machines may be run in parallel, or without b) replacing the first reproduction apparatus with a radically redesigned print engine having double the speed. Both options are very expensive and often with regard to option (b), not possible.

Another option for increasing reproduction apparatus throughput is to utilize a second print engine in series with a first print engine. For example, U.S. Pat. No. 7,245,856 discloses a tandem printing system which is configured to reduce image registration errors between a first side image formed by a first print engine and a second side image formed by a second print image. Each of the '856 print engines has a photoconductive belt having a seam. The seams of the photoconductive belt in each print engine are synchronized by tracking a phase difference between seam signals from both belts. Synchronization of a slave print engine to a main print engine occurs once per revolution of the belts, as triggered by a belt seam signal, and the velocity of the slave photoconductor and the velocity of an imager motor and polygon assembly are updated to match the velocity of the master photoconductor. Unfortunately, such a system tends to be susceptible to increasing registration errors during each successive image frame during a photoconductor revolution. Furthermore, given the large inertia of the high-speed rotating polygon assembly, it is difficult to make significant adjustments to the velocity of the polygon assembly in the relatively short time frame of a single photoconductor revolution. This can limit the response of the '856 system on a per revolution basis, and make it even more difficult, if not impossible, to adjust on a more frequent basis.

Therefore, it would be beneficial if there were a less expensive, yet reliable, method and system for enabling a user of a reproduction apparatus to double their simplex and/or duplex throughput while enabling tighter control over print engine synchronization.

SUMMARY OF THE INVENTION

In view of the above, the claimed invention is directed to a method for synchronizing first and second print engines. The print engine synchronization system apparatus enables the movement of a first print engine dielectric support member (DSM) having one or more image frames as well as the movement of a second print engine DSM having one or more image frames by monitoring a first frame signal from the moving first print engine DSM and a second frame signal from the moving second print engine DSM. An offset is determined for each of corresponding pairs of frames from the one or more image frames of the first and second print engine DSM and the determined offset for each corresponding pair of frames is compared to a target offset to maintain synchronization between the first and second print engines on a frame by frame basis by adjusting a second print engine DSM velocity based on the comparison of the determined offset and the target offset. Thus the velocity of the second print engine DSM is adjusted based on the comparison of the determined offset and the target offset to maintain synchronization between the first and second print engines on a frame by frame basis.

The claimed invention is also directed to a method for synchronizing first and second print engines. Movement of a second print engine DSM having a plurality of image frames is enabled. A second splice signal is monitored to locate a splice seam on the second print engine DSM. The located splice seam of the second print engine DSM is placed in at least one known location. Movement of a first print engine DSM having a plurality of image frames is enabled. A first splice signal is monitored to locate a splice seam on the first print engine DSM. The located splice seams from the first and second print engine DSM's are synchronized and separated by a target offset. A first frame signal from the moving first print engine DSM is monitored. A second frame signal from the moving second print engine DSM is monitored. An offset is determined for each of corresponding pairs of frames from the one or more image frames of the first and second print engine DSM's. The determined offset for each corresponding pair of frames is compared to the target offset. The velocity of the second print engine DSM is adjusted based on the comparison of the determined offset and the target offset to maintain synchronization between the first and second print engines on a frame by frame basis.

The claimed invention is further directed to a method of increasing the throughput of a reproduction apparatus having a first print engine. A second print engine is inserted in-line with the first print engine and in-between the first print engine and a finishing device formerly coupled to the first print engine. A first splice signal and a first frame signal from the first print engine are coupled to a controller configured to operate the second print engine. Movement of a second print engine DSM having a plurality of image frames is enabled. A second splice signal is monitored to locate a splice seam on the second print engine DSM. The located splice seam of the second print engine DSM is placed in at least one known location. Movement of a first print engine DSM having a plurality of image frames is enabled. The first splice signal is monitored to locate a splice seam on the first print engine DSM. The located splice seams from the first and second print engine DSM's are synchronized separated by a target offset. The first frame signal from the moving first print engine DSM is monitored. A second frame signal from the moving second print engine DSM is monitored. An offset is determined for each of corresponding pairs of frames from the one or more image frames of the first and second print engine DSM's. The determined offset is compared for each corresponding pair of frames to the target offset. The velocity of the second print engine DSM is adjusted based on the comparison of the determined offset and the target offset to maintain synchronization between the first and second print engines on a frame by frame basis.

The invention, and its objects and advantages, will become more apparent in the detailed description of the preferred embodiment presented below.

Figure 1:
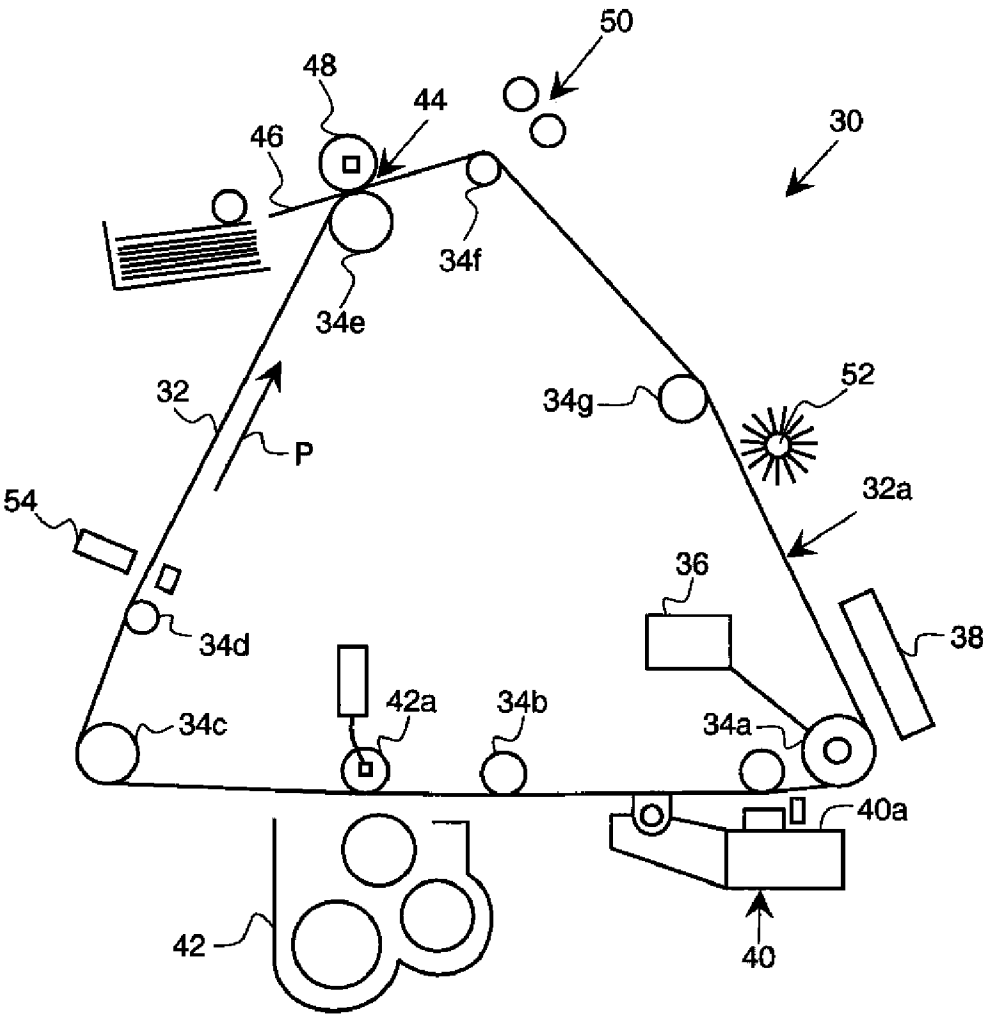
FIG. 1 schematically illustrates an embodiment of an electrophotographic print engine.

It will be appreciated that for purposes of clarity and where deemed appropriate, reference numerals have been repeated in the figures to indicate corresponding features, and that the various elements in the drawings have not necessarily been drawn to scale in order to better show the features.

DETAILED DESCRIPTION OF THE INVENTION

FIG. 1 schematically illustrates an embodiment of an electrophotographic print engine 30. The print engine 30 has a movable recording member such as a photoconductive belt 32 which is entrained about a plurality of rollers or other supports 34*a* through 34*g*. The photoconductive belt 32 may be more generally referred-to as a dielectric support member (DSM) 32. A dielectric support member (DSM) 32 may be any charge carrying substrate which may be selectively charged or discharged by a variety of methods including, but not limited to corona charging/discharging, gated corona charging/discharging, charge roller charging/discharging, ion writer charging, light discharging, heat discharging, and time discharging.

One or more of the rollers 34*a*-34*g* are driven by a motor 36 to advance the DSM 32. Motor 36 preferably advances the DSM 32 at a high speed, such as 20 inches per second or higher, in the direction indicated by arrow P, past a series of workstations of the print engine 30, although other operating speeds may be used, depending on the embodiment. In some embodiments, DSM 32 may be wrapped and secured about only a single drum. In further embodiments, DSM 32 may be coated onto or integral with a drum.

Print engine 30 may include a controller or logic and control unit (LCU) (not shown). The LCU may be a computer, microprocessor, application specific integrated circuit (ASIC), digital circuitry, analog circuitry, or an combination or plurality thereof. The controller (LCU) may be operated according to a stored program for actuating the workstations within print engine 30, effecting overall control of print engine 30 and its various subsystems. The LCU may also be programmed to provide closed-loop control of the print engine 30 in response to signals from various sensors and encoders. Aspects of process control are described in U.S. Pat. No. 6,121,986 incorporated herein by this reference.

A primary charging station 38 in print engine 30 sensitizes DSM 32 by applying a uniform electrostatic corona charge, from high-voltage charging wires at a predetermined primary voltage, to a surface 32*a* of DSM 32. The output of charging station 38 may be regulated by a programmable voltage controller (not shown), which may in turn be controlled by the LCU to adjust this primary voltage, for example by controlling the electrical potential of a grid and thus controlling movement of the corona charge. Other forms of chargers, including brush or roller chargers, may also be used.

An image writer, such as exposure station 40 in print engine 30, projects light from a writer 40*a* to DSM 32. This light selectively dissipates the electrostatic charge on photoconductive DSM 32 to form a latent electrostatic image of the document to be copied or printed. Writer 40*a* is preferably constructed as an array of light emitting diodes (LEDs), or alternatively as another light source such as a Laser or spatial light modulator. Writer 40*a* exposes individual picture elements (pixels) of DSM 32 with light at a regulated intensity and exposure, in the manner described below. The exposing light discharges selected pixel locations of the photoconductor, so that the pattern of localized voltages across the photoconductor corresponds to the image to be printed. An image is a pattern of physical light, which may include characters, words, text, and other features such as graphics, photos, etc. An image may be included in a set of one or more images, such as in images of the pages of a document. An image may be divided into segments, objects, or structures each of which is itself an image. A segment, object or structure of an image may be of any size up to and including the whole image.

After exposure, the portion of DSM 32 bearing the latent charge images travels to a development station 42. Development station 42 includes a magnetic brush in juxtaposition to the DSM 32. Magnetic brush development stations are well known in the art, and are preferred in many applications; alternatively, other known types of development stations or devices may be used. Plural development stations 42 may be provided for developing images in plural grey scales, colors, or from toners of different physical characteristics. Full process color electrographic printing is accomplished by utilizing this process for each of four toner colors (e.g., black, cyan, magenta, yellow).

Upon the imaged portion of DSM 32 reaching development station 42, the LCU selectively activates development station 42 to apply toner to DSM 32 by moving backup roller 42*a* and DSM 32, into engagement with or close proximity to the magnetic brush. Alternatively, the magnetic brush may be moved toward DSM 32 to selectively engage DSM 32. In either case, charged toner particles on the magnetic brush are selectively attracted to the latent image patterns present on DSM 32, developing those image patterns. As the exposed photoconductor passes the developing station, toner is attracted to pixel locations of the photoconductor and as a result, a pattern of toner corresponding to the image to be printed appears on the photoconductor. As known in the art, conductor portions of development station 42, such as conductive applicator cylinders, are biased to act as electrodes. The electrodes are connected to a variable supply voltage, which is regulated by a programmable controller in response to the LCU, by way of which the development process is controlled.

Development station 42 may contain a two-component developer mix which comprises a dry mixture of toner and carrier particles. Typically the carrier preferably comprises high coercivity (hard magnetic) ferrite particles. As a non-limiting example, the carrier particles may have a volume-weighted diameter of approximately 30μ. The dry toner particles are substantially smaller, on the order of 6μ to 15μ in volume-weighted diameter. Development station 42 may include an applicator having a rotatable magnetic core within a shell, which also may be rotatably driven by a motor or other suitable driving means. Relative rotation of the core and shell moves the developer through a development zone in the presence of an electrical field. In the course of development, the toner selectively electrostatically adheres to DSM 32 to develop the electrostatic images thereon and the carrier material remains at development station 42. As toner is depleted from the development station due to the development of the electrostatic image, additional toner may be periodically introduced by a toner auger (not shown) into development station 42 to be mixed with the carrier particles to maintain a uniform amount of development mixture. This development mixture is controlled in accordance with various development control processes. Single component developer stations, as well as conventional liquid toner development stations, may also be used.

A transfer station 44 in printing machine 10 moves a receiver sheet 46 into engagement with the DSM 32, in registration with a developed image to transfer the developed image to receiver sheet 46. Receiver sheets 46 may be plain or coated paper, plastic, or another medium capable of being handled by the print engine 30. Typically, transfer station 44 includes a charging device for electrostatically biasing movement of the toner particles from DSM 32 to receiver sheet 46. In this example, the biasing device is roller 48, which engages the back of sheet 46 and which may be connected to a programmable voltage controller that operates in a constant current mode during transfer. Alternatively, an intermediate member may have the image transferred to it and the image may then be transferred to receiver sheet 46. After transfer of the toner image to receiver sheet 46, sheet 46 is detacked from DSM 32 and transported to fuser station 50 where the image is fixed onto sheet 46, typically by the application of heat and/or pressure. Alternatively, the image may be fixed to sheet 46 at the time of transfer.

A cleaning station 52, such as a brush, blade, or web is also located beyond transfer station 44, and removes residual toner from DSM 32. A pre-clean charger (not shown) may be located before or at cleaning station 52 to assist in this cleaning. After cleaning, this portion of DSM 32 is then ready for recharging and re-exposure. Of course, other portions of DSM 32 are simultaneously located at the various workstations of print engine 30, so that the printing process may be carried out in a substantially continuous manner.

A controller provides overall control of the apparatus and its various subsystems with the assistance of one or more sensors which may be used to gather control process input data. One example of a sensor is belt position sensor 54.

Figure 2:
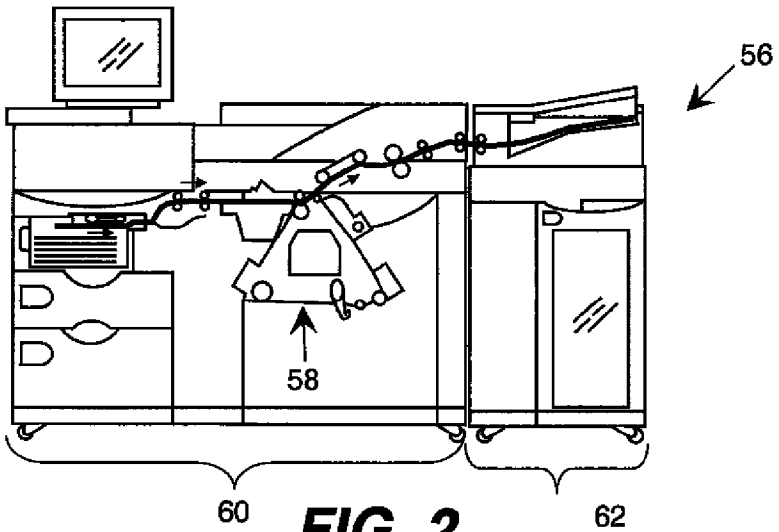
FIG. 2 schematically illustrates an embodiment of a reproduction apparatus having a first print engine.

FIG. 2 schematically illustrates an embodiment of a reproduction apparatus 56 having a first print engine 58. The embodied reproduction apparatus will have a particular throughput, which may be measured in pages per minute (ppm). As explained above, it would be desirable to be able to significantly increase the throughput of such a reproduction apparatus 56 without having to purchase an entire second reproduction apparatus. It would also be desirable to increase the throughput of reproduction apparatus 56 without having to scrap apparatus 56 and replacing it with an entire new machine.

Quite often, reproduction apparatus 56 is made up of modular components. For example, the print engine 58 is housed within a main cabinet 60 that is coupled to a finishing unit 62. For simplicity, only a single finishing device 62 is shown, however, it should be understood that multiple finishing devices providing a variety of finishing functionality are known to those skilled in the art and may be used in place of a single finishing device. Depending on its configuration, the finishing device 62 may provide stapling, hole punching, trimming, cutting, slicing, stacking, paper insertion, collation, sorting, and binding.

Figure 3A:
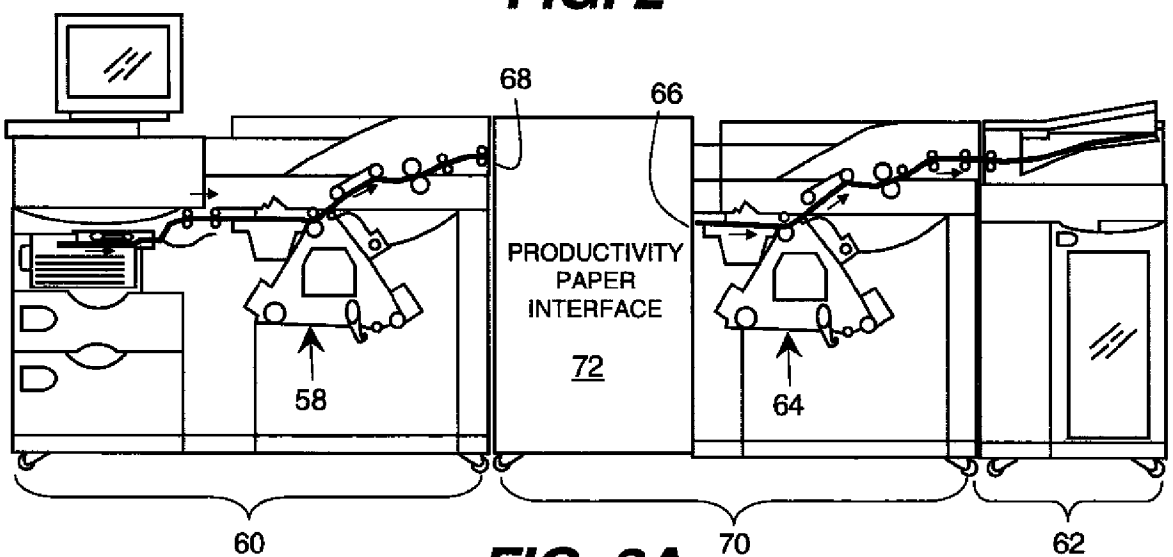
FIGS. 3A-3C schematically illustrate embodiments of a reproduction apparatus having a first print engine and a tandem second print engine from a productivity module.
Figure 3B:
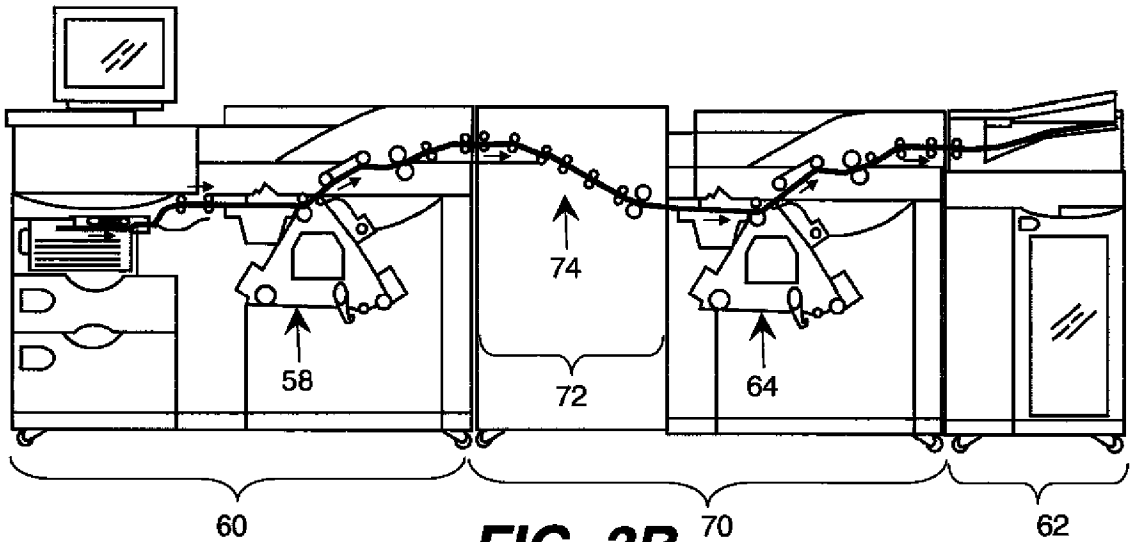
Figure 3C:
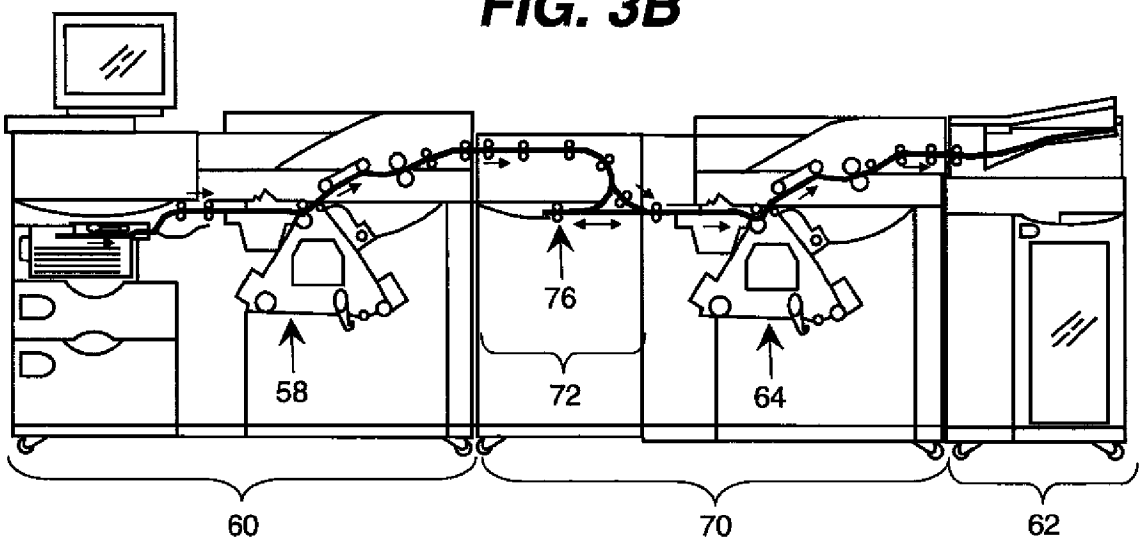

As FIG. 3A schematically illustrates, a second print engine 64 may be inserted in-line with the first print engine 58 and in-between the first print engine 58 and the finishing device 62 formerly coupled to the first print engine 58. The second print engine 64 may have an input paper path point 66 which does not align with the output paper path point 68 from the first print engine 58. Additionally, or optionally, it may be desirable to invert the receiver sheets from the first print engine 58 prior to running them through the second print engine (in the case of duplex prints). In such instances, the productivity module 70 which is inserted between the first print engine 58 and the at least one finisher 62 may have a productivity paper interface 72. Some embodiments of a productivity paper interface 72 may provide for matching 74 of differing output and input paper heights, as illustrated in the embodiment of FIG. 3B. Other embodiments of a productivity paper interface 72 may provide for inversion 76 of receiver sheets, as illustrated in the embodiment of FIG. 3C.

Providing users with the option to re-use their existing equipment by inserting a productivity module 70 between their first print engine 58 and their one or more finishing devices 62 can be economically attractive since the second print engine 64 of the productivity module 70 does not need to come equipped with the input paper handling drawers coupled to the first print engine 58. Furthermore, the second print engine 64 can be based on the existing technology of the first print engine 58 with control modifications which will be described in more detail below to facilitate synchronization between the first and second print engines.

Figure 4:
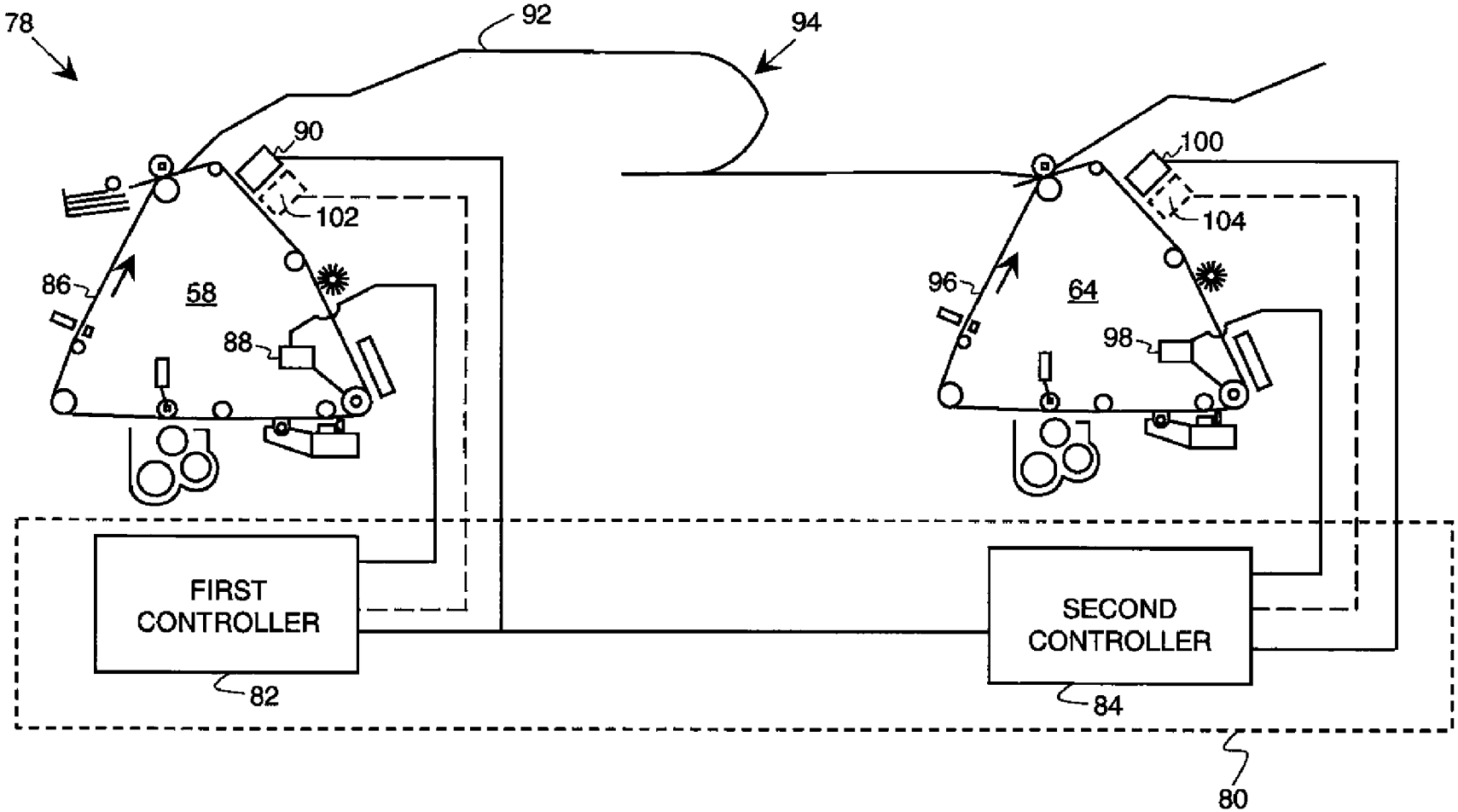
FIG. 4 schematically illustrates an embodiment of a reproduction apparatus having embodiments of first and second print engines which are synchronized by a controller.

FIG. 4 schematically illustrates an embodiment of a reproduction apparatus 78 having embodiments of first and second print engines 58, 64 which are synchronized by a controller 80. Controller 80 may be a computer, a microprocessor, an application specific integrated circuit, digital circuitry, analog circuitry, or any combination and/or plurality thereof. In this embodiment, the controller 80 includes a first controller 82 and a second controller 84. Optionally, in other embodiments, the controller 80 could be a single controller as indicated by the dashed line for controller 80. The first print engine 58 has a first dielectric support member (DSM) 86, the features of which have been discussed above with regard to the DSM of FIG. 1. The first DSM 86 also preferably has a plurality of frame markers corresponding to a plurality of frames on the DSM 86. In some embodiments, the frame markers may be holes or perforations in the DSM 86 which an optical sensor can detect. In other embodiments, the frame markers may be reflective or diffuse areas on the DSM, which an optical sensor can detect. Other types of frame markers will be apparent to those skilled in the art and are intended to be included within the scope of this specification. The first print engine 58 also has a first motor 88 coupled to the first DSM 86 for moving the first DSM when enabled. As used here, the term "enabled" refers to embodiments where the first motor 88 may be dialed in to one or more desired speeds as opposed to just an on/off operation. Other embodiments, however, may selectively enable the first motor 88 in an on/off fashion or in a pulse-width-modulation fashion.

The first controller 82 is coupled to the first motor 88 and is configured to selectively enable the first motor 88 (for example, by setting the motor for a desired speed, by turning the motor on, and/or by pulse-width-modulating an input to the motor). A first frame sensor 90 is also coupled to the first controller 82 and configured to provide a first frame signal, based on the first DSM's plurality of frame markers, to the first controller 82.

A second print engine 64 is coupled to the first print engine 58, in this embodiment, by a paper path 92 having an inverter 94. The second print engine 64 has a second dielectric support member (DSM) 96, the features of which have been discussed above with regard to the DSM of FIG. 1. The second DSM 96 also preferably has a plurality of frame markers corresponding to a plurality of frames on the DSM 96. In some embodiments, the frame markers may be holes or perforations in the DSM 96, which an optical sensor can detect. In other embodiments, the frame markers may be reflective or diffuse areas on the DSM which an optical sensor can detect. Other types of frame markers will be apparent to those skilled in the art and are intended to be included within the scope of this specification. The second print engine 64 also has a second motor 98 coupled to the second DSM 96 for moving the second DSM 96 when enabled. As used here, the term "enabled" refers to embodiments where the second motor 98 may be dialed in to one or more desired speeds as opposed to just an on/off operation. Other embodiments, however, may selectively enable the second motor 98 in a pulse-width-modulation fashion.

The second controller 84 is coupled to the second motor 98 and is configured to selectively enable the second motor 98 (for example, by setting the motor for a desired speed, or by pulse-width-modulating an input to the motor). A second frame sensor 100 is also coupled to the second controller 84 and configured to provide a second frame signal, based on the second DSM's plurality of frame markers, to the second controller 84. The second controller 84 is also coupled to the first frame sensor 90 either directly as illustrated or indirectly via the first controller 82 which may be configured to pass data from the first frame sensor 90 to the second controller 84.

While the operation of each individual print engine 58 and 64 has been described on its own, the second controller 84 is also configured to synchronize the first and second print engines 58, 64 on a frame-by-frame basis. Optionally, the second controller 84 may also be configured to synchronize a first DSM splice seam from the first DSM 86 with a second DSM splice seam from the second DSM 96. In the embodiments which synchronize the DSM splice seams, the first print engine 58 may have a first splice sensor 102 and the second print engine 64 may have a second splice sensor 104. In other embodiments, the frame sensors 90, 100 may be configured to double as splice sensors. Embodiments of the synchronization which the second controller 84 may be configured to implement will be discussed further-on with regard to FIGS. 6 and 7, but first, FIG. 5 schematically illustrates the importance of synchronizing frames as well as optionally synchronizing DSM splice seams between the first and second print engines.

Figure 5:
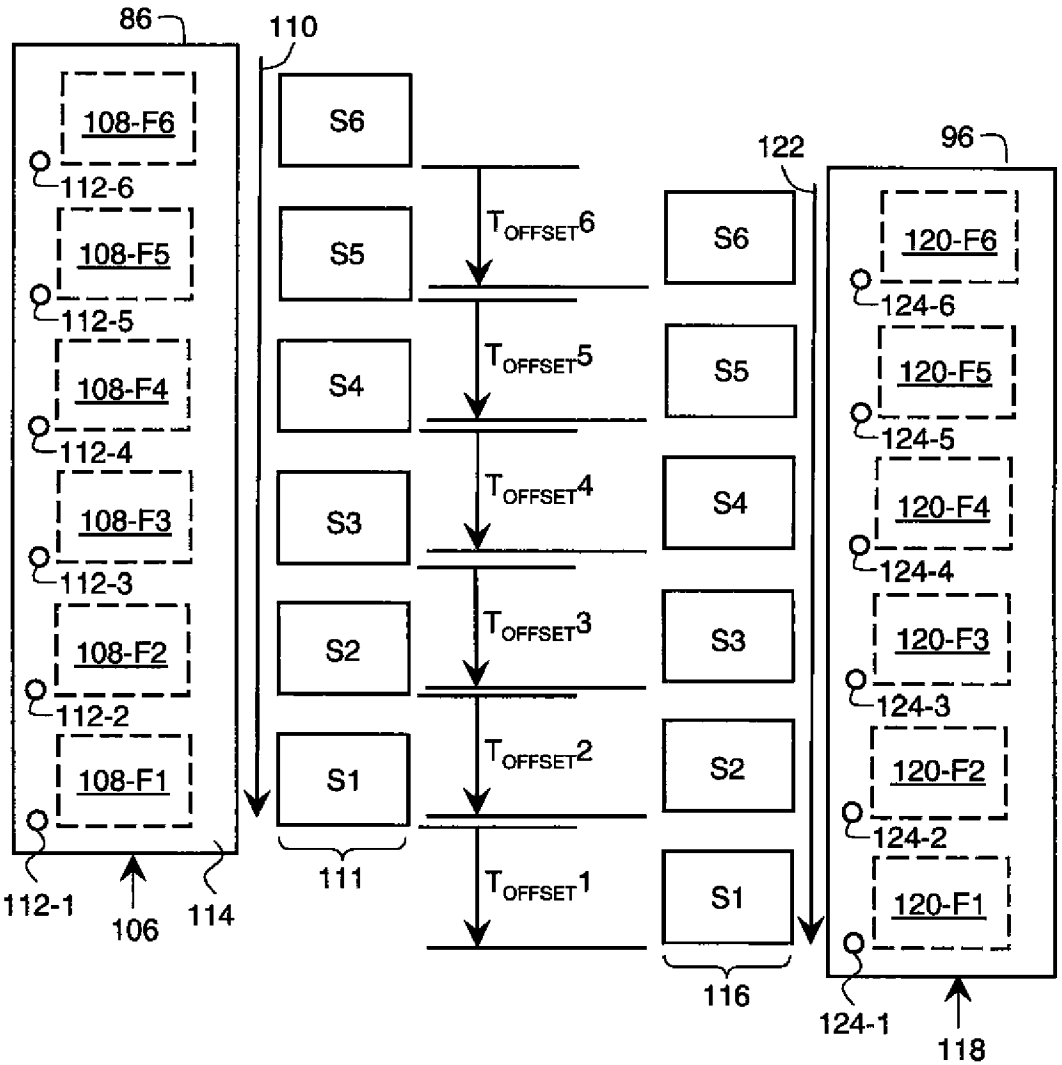
FIG. 5 schematically illustrates time offsets between image frames on a first dielectric support member (DSM) and image frames on a second DSM.

FIG. 5 schematically illustrates a first dielectric support member (DSM) 86 sliced open on its first splice 106 and laid flat so that all of the first image frames 108-F1 through 108-F6 can be seen. When the motor coupled to the first DSM 86 is enabled, the first DSM 86 moves in a direction 110 which is substantially matched in direction and speed to receiver sheets S1-S6 during a first time period 111. The first DSM 86 has a plurality of frame markers 112-1 through 112-6 corresponding to image frames 108-F1 through 108-F6. The first controller may be configured to move receiver sheets S1 through S6 so that the sheets align as desired with the corresponding set of first image frames 108-F1 through 108-F6. A first splice marker 114 may be provided to indicate the position of the splice.

When using print engines in tandem, FIG. 5 also schematically illustrates that during a second time period 116 the receiver sheets S1 through S6 will sequentially come into contact with the second dielectric support member (DSM) 96. Second DSM 96 is sliced open on its first splice 118 and laid flat so that all of the second image frames 120-F1 through 120-F6 can be seen. When the motor coupled to the second DSM 96 is enabled, the second DSM 96 moves in a direction 122, which is substantially matched in direction and speed to receiver sheets S1-S6 during the second time period 116. The second DSM 96 also has a plurality of frame markers 124-1 through 124-6 corresponding to image frames 120-F1 through 120-F6.

Ideally, the position of the second DSM 96 image frames will be synchronized with the position of the first DSM 86 image frames with an appropriate offset in time to account for the distance the receiver sheets travel between the first print engine and the second print engine at a particular speed. Prior art solutions which simply synchronize once based on splice position can drift over time due to variations in first and second DSM lengths and motor non-linearity and fluctuation. Even prior art solutions, which attempt to synchronize the DSM's once per revolution of the DSM, can experience drift between frames.

An offset ($T_{offset}$1 through $T_{offset}$6) may be determined for each corresponding set of frames between the first DSM 86 and the second DSM 96. For example, $T_{offset}$1 is the offset between the start of frame 108-F1 and frame 120-F1. Ideally the offset is substantially equal to a predetermined or calibrated offset between the first and second print engines based on the length of the paper-path between the first and second print engines and the speed the receiver sheets are moving through the paper path. Unfortunately, the variations discussed can lead to drift between the determined actual offset and a target offset.

Figure 6:
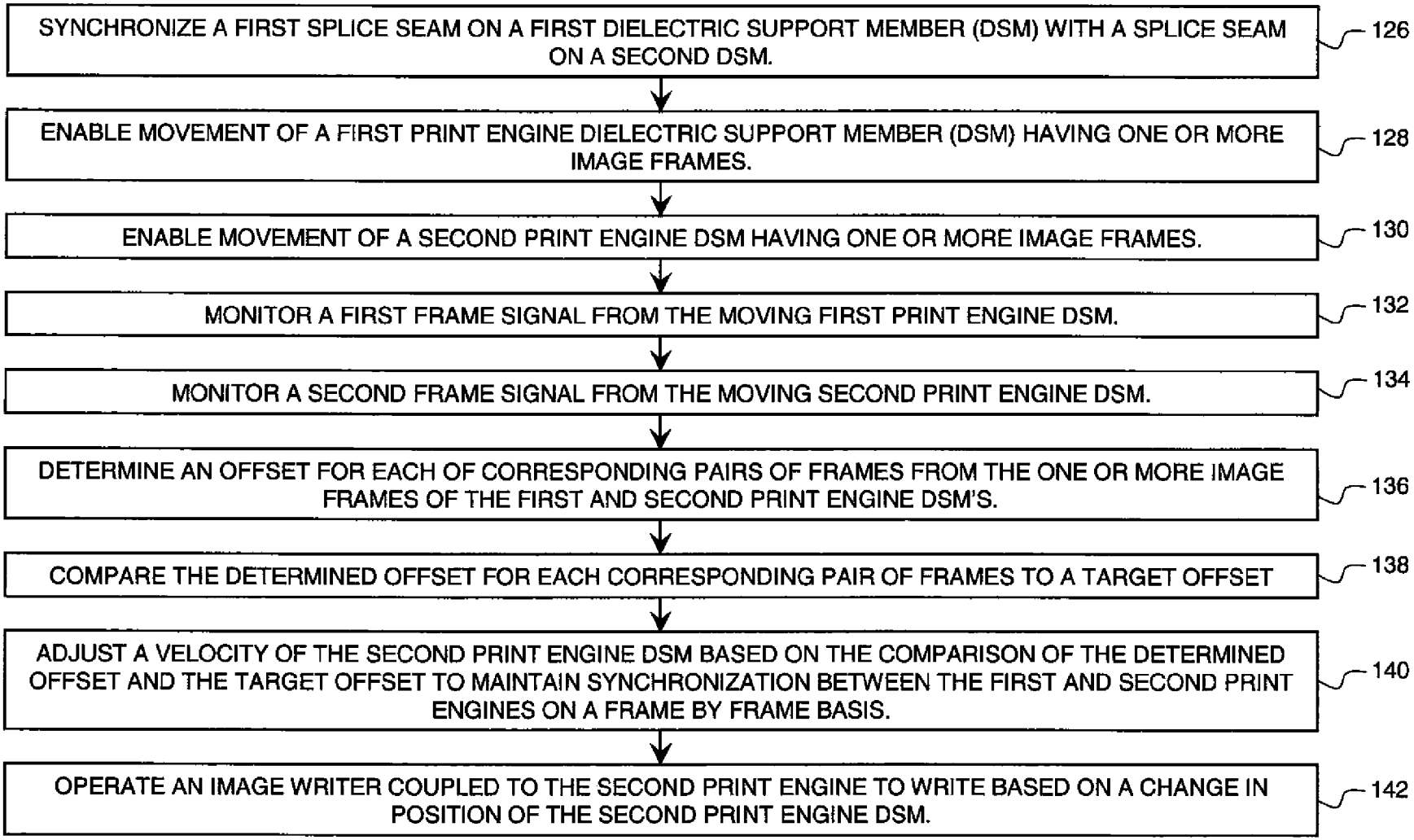
FIG. 6 illustrates one embodiment of a method for synchronizing first and second print engines.

FIG. 6 illustrates one embodiment of a method for synchronizing first and second print engines. Optionally, a first splice seam on a first dielectric support member (DSM) is synchronized 126 with a second splice seam on a second DSM. Synchronizing the splice seams, if the DSM has splice seams, can have the advantage of providing a more consistent interframe spacing, since the interframe area containing the splice seam may be a different length than the other interframe areas. Although there may be variations in DSM construction, it is still preferable to align the splices for interframe consistency.

Movement of a first print engine dielectric support member (DSM) having one or more image frames is enabled 128. The enabling action may take a variety of forms, including, but not limited to, providing a fixed current, providing a variable current, providing a fixed voltage, providing a variable voltage, or providing a pulse-width modulated voltage to a first motor coupled to the first DSM. Movement of a second print engine DSM having one or more image frames is enabled 130. The enabling action may take a variety of forms, including, but not limited to, providing a fixed current, providing a variable current, providing a fixed voltage, providing a variable voltage, or providing a pulse-width modulated voltage to a second motor coupled to the second DSM.

A first frame signal from the moving first print engine DSM is monitored 132. The first frame signal being monitored may come from a variety of sources, for example, but not limited to, one or more frame perforations, one or more frame marks, one or more frame holes, one or more frame reflective areas, or one or more frame diffuse areas on or defined by the second DSM. A second frame signal from the moving second print engine DSM is monitored 134. Similar to the first frame signal, The second frame signal being monitored may come from a variety of sources, for example, but not limited to, one or more frame perforations, one or more frame marks, one or more frame holes, one or more frame reflective areas, or one or more frame diffuse areas on or defined by the second DSM.

An offset is determined 136 for each of corresponding pairs of frames from the one or more image frames of the first and second print engine DSM's. In some embodiments, the determined offset for each of the corresponding pairs may be an offset time between the corresponding frames. In other embodiments, the determined offset for each of the corresponding pairs may be an offset distance produced by multiplying an offset time by a velocity of travel.

The determined offset for each corresponding pair of frames is compared to a target offset. In some embodiments, the target offset may be preset based on a nominal operating speed of a paper path between the first and second print engines multiplied by a known length of the paper path. In other embodiments, the target offset may be determined based on a calibration routine. The calibration routine could be a manual adjustment to a nominal target offset value. In some embodiments, the calibration routine could include 1) printing a target timing mark on a sheet of paper with the first print engine; 2) printing a set of calibration timing marks with corresponding offsets on the sheet of paper with the second print engine; 3) selecting a calibration timing mark from the set of calibration timing marks which is closest to the target timing mark; and 4) providing a controller for the second print engine with the offset corresponding to the selected closest calibration timing mark. In still other embodiments, the calibration routine can be accomplished automatically by monitoring the timing of the receiver sheet-handling path. The reproduction apparatus may be configured with receiver sheet handling path sensors which note the passage of the receiver sheet from the first print engine to the second print engine. Thus, the actual target offset time between the two print engines may be determined as the automatically measured time between receiver sheet handling path sensor readings or some number proportional thereto. In further embodiments, the calibration routine could be based on a dwell time in the receiver sheet path between the first print engine and the second print engine. For example, if the productivity paper interface 72 is an inverter, then after flipping the receiver sheet, the inverter drive rollers may have some delay or dwell time until their controller has them forward the receiver sheet to the following print engine. Therefore, the dwell time may be proportional to the target offset time and the target offset time may be calibrated automatically based on the dwell time which is set.

A velocity of the second print engine DSM is adjusted 140 based on the comparison of the determined offset and the target offset to maintain synchronization between the first and second print engines on a frame by frame basis. This adjustment may include providing the difference between the determined offset and the target offset to a control loop, for example, but not limited to a proportional plus integral control loop or a proportional plus integral plus derivative control loop. Such loops are known to those skilled in the art, for example the types of control loops used in a servo control system. It may even be preferable to set-up the motor coupled to the second DSM as a servo controlled motor.

Depending on the capabilities of the second print engine, the image writer coupled to the second print engine may be configured to operate independently of DSM velocity. One example of such an image writer is an LED writer array. Such an LED writer array writes based on a change in position of the DSM as tracked by a system encoder coupled to the belt movement. The writer monitors the motion of the DSM and when it is determined that the DSM has advanced a line, the LED writer array writes the line. Since the writer is DSM-position-based, there is no downside to changing the velocity of the DSM on the fly, even on a frame-by-frame or more frequent basis. When making frame-by-frame synchronization adjustments, an image writer with a quick response time, such as an LED array, can be an enabling factor, since certain image writers such as spinning polygon mirrors may have too much inertia to be adjusted independently of DSM velocity on an interframe basis. Therefore, optionally, an image writer coupled to the second print engine may be operated 142 to write based on a change in position of the second print engine's DSM. This will enhance the robustness of the second print engine by making the writer immune to changes in DSM velocity.

Figure 7:
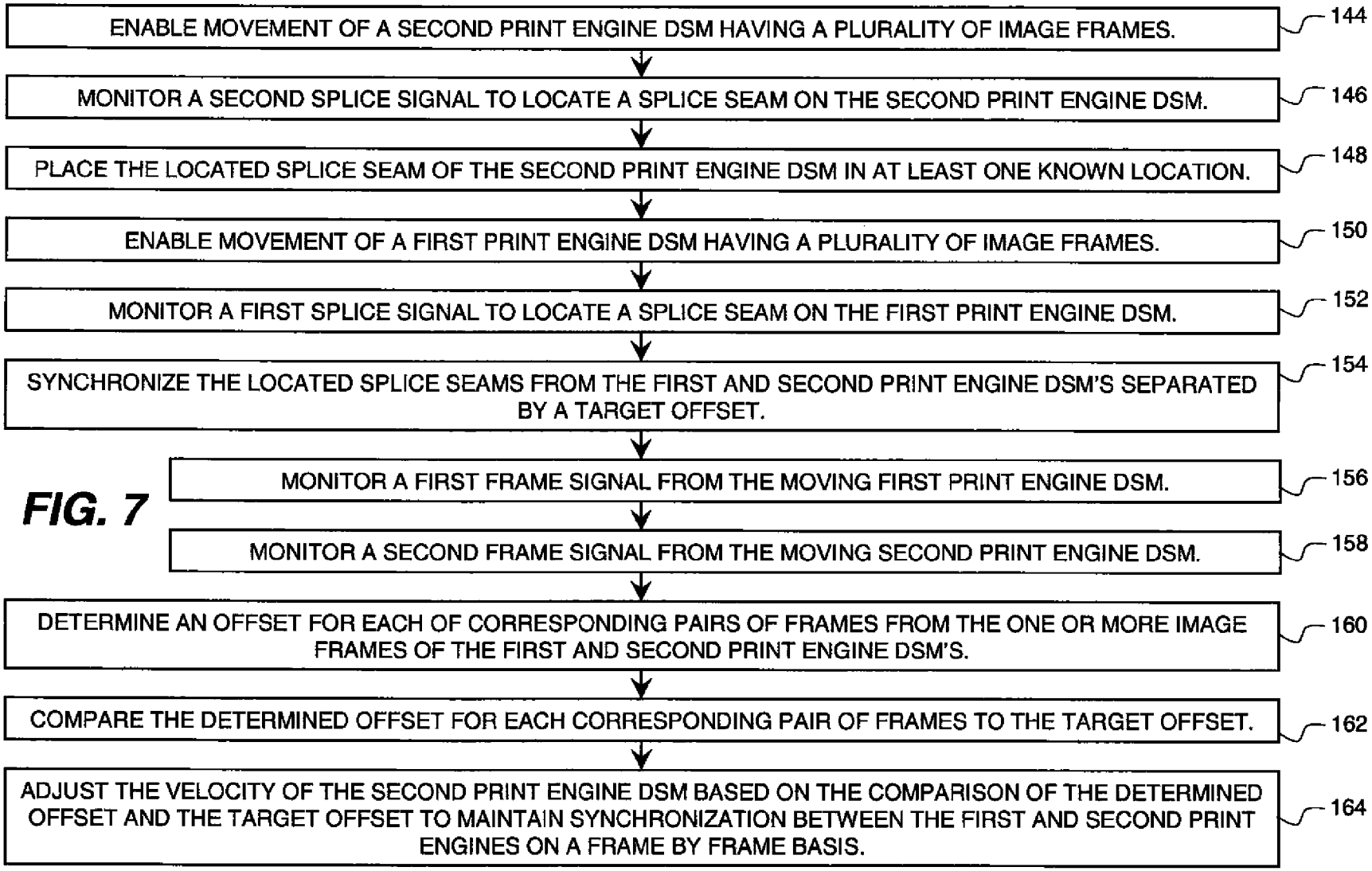
FIG. 7 illustrates another embodiment of a method for synchronizing first and second print engines.

FIG. 7 illustrates another embodiment of a method for synchronizing first and second print engines. Movement of a second print engine DSM having a plurality of image frames is enabled 144. A second splice signal is monitored 146 to locate a splice seam on the second print engine DSM. The located splice seam of the second print engine DSM is placed 148 in at least one known location. If the located splice seam of the second print engine is placed in a single known location, then the second DSM is parked in a known location. If the located splice seam of the second print engine is placed in more than one known location, then the second DSM is moving, but the location of the seam is being tracked and therefore the known locations keep changing.

Movement of a first print engine DSM having a plurality of image frames is enabled 150. A first splice signal is monitored 152 to locate a splice seam on the first print engine DSM. The located splice seams from the first and second print engine DSM's are synchronized 154 and separated by a target offset. If the second DSM had been parked, then it is started-up or enabled again for the splice seam synchronization.

A first frame signal from the moving first print engine DSM is monitored 156. The first frame signal will indicate the presence or absence of a frame marker on the first DSM as the first frame markers move past a first frame sensor. A second frame signal from the moving second print engine DSM is monitored 158. The second frame signal will indicate the presence or absence of a frame marker on the second DSM as the second frame markers move past a second frame sensor. An offset is determined 160 for each of corresponding pairs of frames from the one or more image frames of the first and second print engine DSM's. The determined offset for each corresponding pair of frames is compared 162 to the target offset. The velocity of the second print engine DSM is adjusted 164 based on the comparison of the determined offset and the target offset to maintain synchronization between the first and second print engines on a frame by frame basis.

Figure 8:
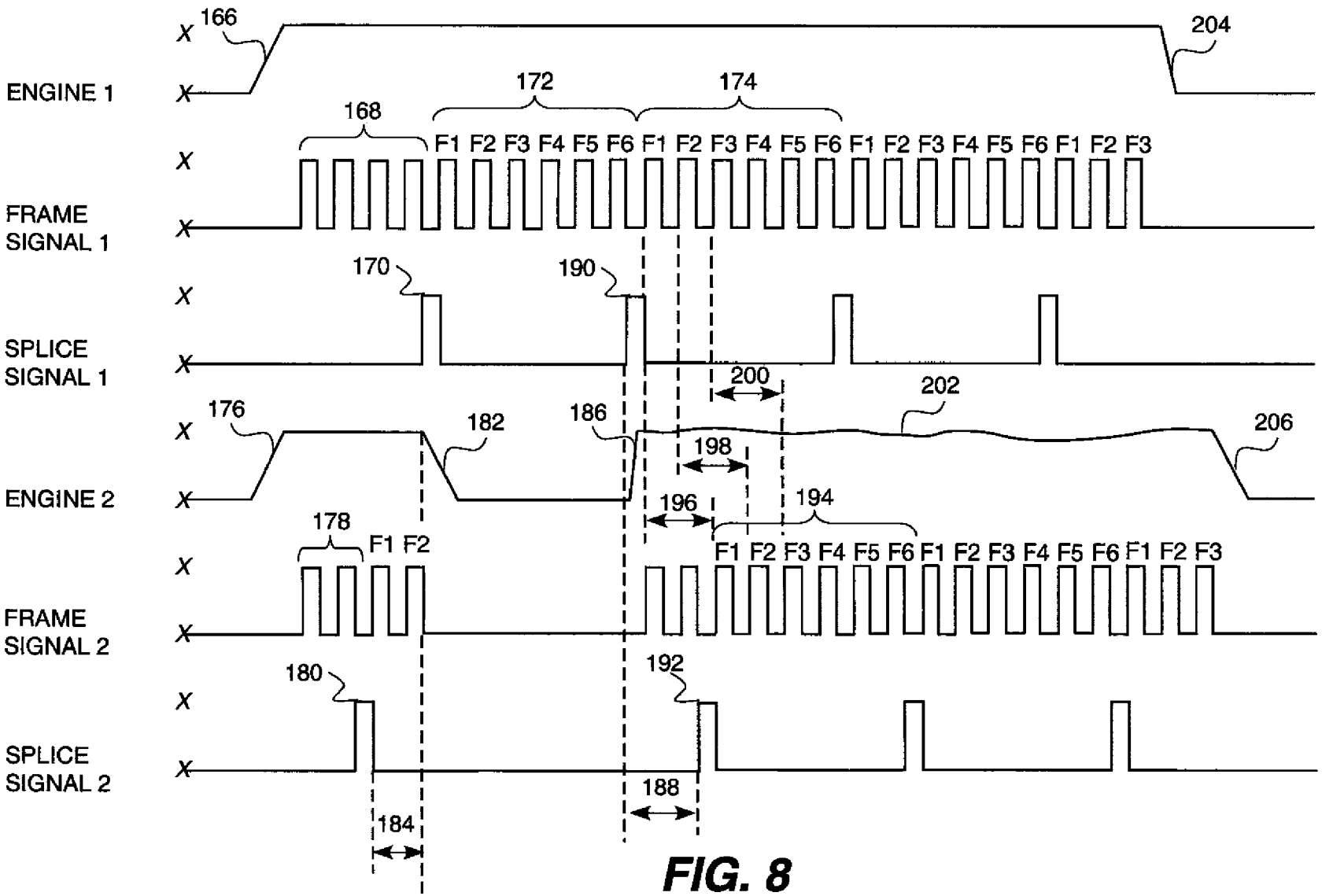
FIG. 8 schematically illustrates a timing diagram representing an embodiment of print engine synchronization.

FIG. 8 schematically illustrates a timing diagram representing an embodiment of print engine synchronization. As a first print engine is enabled 166 and the first DSM begins to move, the first frame signal produced by the first frame sensor shows unknown frame pulses 168. The frame pulses are unknown 168 because the location of the first splice has not been determined yet. Eventually, the first splice signal indicates the position 170 of the first splice. From that point on, the individual first frame pulses 172, 174, and so on in a repetitive fashion can be correlated to image frame positions F1 through F6 as illustrated.

As a second print engine is enabled 176 and the second DSM begins to move, the second frame signal produced by the second frame sensor shows unknown frame pulses 178. As before, the frame pulses are unknown 178 because the location of the second splice has not been determined yet. Eventually, the second splice signal indicates the position 180 of the second splice. The second print engine is disabled 182 a desired time 184 after the second splice is detected in order to park the second splice in a known location.

The second print engine may be enabled again 186 at a time calculated to create a starting offset 188 between the first splice 190 and the second splice 192. This establishes the initial synchronization between the first and second splice seams. The recognition of the first splice seam 190 allows the identification of the first image frames F1 through F6 (174) in the first frame signal. Similarly, the recognition of the second splice seam 192 allows the identification of the second image frames F1 through F6 (194) in the second frame signal.

The offsets for corresponding pairs of frames can be determined. For example, offset 196 is the offset between first image frame F1 from the first frame signal and second image frame F1 from the second frame signal. Similarly, offset 198 is the offset between first image frame F2 from the first frame signal and second image frame F2 from the second frame signal. Offset 200 is the offset between first image frame F3 from the first frame signal and second image frame F3 from the second frame signal, and so on.

The determined offsets are compared to a target offset, and the velocity of the second print engine DSM is adjusted as schematically illustrated by the fluctuating portion 202 corresponding to the Engine 2 input. The synchronization occurs on a frame-by-frame basis until it is desired to shut down the first engine 204 and to shut down the second engine 206.

Figure 9:
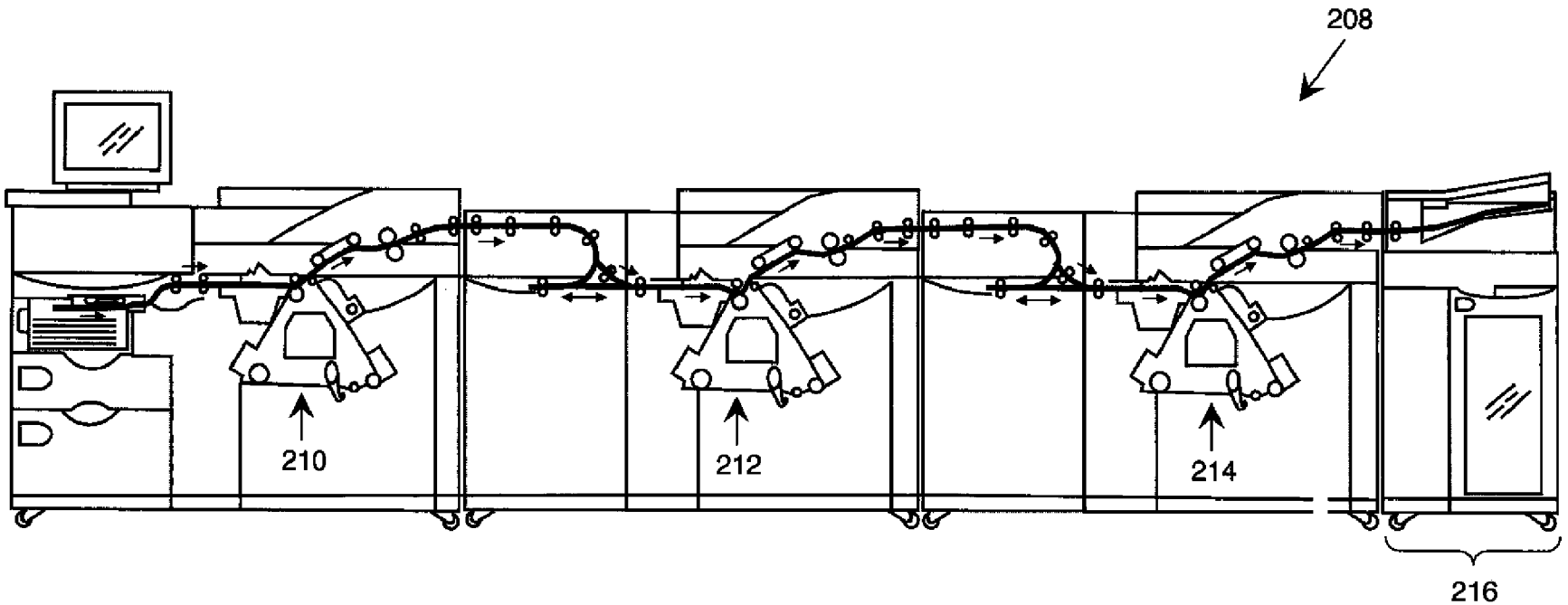
FIG. 9 illustrates another embodiment of a reproduction apparatus.

The advantages of a system and method for print engine synchronization have been discussed herein. Embodiments discussed have been described by way of example in this specification. It will be apparent to those skilled in the art that the foregoing detailed disclosure is intended to be presented by way of example only, and is not limiting. For example, the dielectric support members (DSM's) discussed in the embodiments often were illustrated as having six image frames. Other dielectric support members, however, could have fewer or greater numbers of image frames depending on the size of the DSM, the size of the images being printed, and the overall design of the system. Furthermore, although the embodiments herein have been illustrated with a single productivity print engine module inserted in-line with an existing print engine, other embodiments may have any number of additional print engines inserted in-line with the existing print engine. For example, see the reproduction apparatus 208 illustrated in FIG. 9. In addition to the main print engine 210, a second print engine 212 and a third print engine 214 have been installed inline between the main print engine 212 and the finishing device 216. The second print engine 212 may be synchronized with the main print engine 210 using the methods disclosed herein and their equivalents. The third print engine 214 may also be synchronized with the main print engine 210 using the methods disclosed herein and their equivalents. In this case, the target offset will be based on the transit time from the main engine 210 to the third engine 214. Alternatively, the third print engine 214 could be synchronized with the second print engine 212 using the methods disclosed herein and their equivalents. One of the benefits of the disclosed methods is that it allows for the synchronization between any pair of print engines in the print engine chain. Although it is preferable that the first print engine in the chain of print engines be the main print engine, the end or any of the middle print engines could be the main print engines which the other print engines are directly or indirectly synchronized from.

The invention has been described in detail with particular reference to certain preferred embodiments thereof, but it will be understood that variations and modifications can be effected within the spirit and scope of the invention.

PARTS LIST

30 print engine
32 dielectric support member (DSM)
34*a* driven roller
34*b* roller
34*c* roller
34*d* roller
34*e* roller
34*f* roller
34*g* roller
36 motor
38 primary charging station
40 exposure station (image writer)
40*a* writer
42 development station
42*a* backup roller
44 transfer station
46 receiver sheet
48 biasing roller
50 fuser station
52 cleaning station
54 belt position sensor
56 reproduction apparatus
58 first print engine
60 main cabinet
62 finishing device
64 second print engine
66 input paper path point
68 output paper path point
70 productivity module
72 productivity paper interface
74 matching of differing output and input paper heights
76 inversion of receiver sheets
78 reproduction apparatus
80 controller

82 first controller
84 second controller
86 first dielectric support member (DSM)
88 first motor
90 first frame sensor
92 paper path
94 inverter
96 second dielectric support member (DSM)
98 second motor
100 second frame sensor
102 first splice sensor
104 second splice sensor
106 splice for first DSM
108-F1 image frame 1 on the first DSM
108-F2 image frame 2 on the first DSM
108-F3 image frame 3 on the first DSM
108-F4 image frame 4 on the first DSM
108-F5 image frame 5 on the first DSM
108-F6 image frame 6 on the first DSM
110 direction of first DSM movement
S1 first receiver sheet
S2 second receiver sheet
S3 third receiver sheet
S4 fourth receiver sheet
S5 fifth receiver sheet
S6 sixth receiver sheet
111 first time period for receiver sheets S1-S6
112-1 frame marker 1 on the first DSM
112-2 frame marker 2 on the first DSM
112-3 frame marker 3 on the first DSM
112-4 frame marker 4 on the first DSM
112-5 frame marker 5 on the first DSM
112-6 frame marker 6 on the first DSM
114 splice marker on the first DSM
116 second time period for receiver sheets S1-S6
118 splice for second DSM
120-F1 image frame 1 on second DSM
120-F2 image frame 2 on second DSM
120-F3 image frame 3 on second DSM
120-F4 image frame 4 on second DSM
120-F5 image frame 5 on second DSM
120-F6 image frame 6 on second DSM
122 direction of second DSM movement
124-1 frame marker 1 on the second DSM
124-2 frame marker 2 on the second DSM
124-3 frame marker 3 on the second DSM
124-4 frame marker 4 on the second DSM
124-5 frame marker 5 on the second DSM
124-6 frame marker 6 on the second DSM
166 first print engine enabled
168 unknown image frames in the first frame signal
170 first splice on the first splice signal
172 first frame pulses F1-F6 in the first frame signal
174 repetition of first frame pulses F1-F6 in the first frame signal
176 second print engine enabled
178 unknown frame pulses in the second frame signal
180 position of the second splice
182 disable of the second print engine
184 desired disable time after second splice
186 second print engine re-enabled
188 starting offset
190 first splice
192 second splice
194 second image frames F1-F6 in the second frame signal
196 offset between first image frame F1 from the first frame signal and second image frame F1 from the second frame signal
198 offset between first image frame F2 from the first frame signal and second image frame F2 from the second frame signal
200 offset between first image frame F3 from the first frame signal and second image frame F3 from the second frame signal
202 fluctuating portion of the engine 2 input
204 first engine shutdown
206 second engine shutdown
208 reproduction apparatus
210 first print engine
212 second print engine
214 third print engine
216 finishing device

What is claimed is:

1. A method for synchronizing first and second print engines, comprising:

enabling movement of a first print engine dielectric support member (DSM) having plurality of frame markers corresponding to a plurality of image frames;

enabling movement of a second print engine DSM having plurality of frame markers corresponding to a plurality of image frames on the first print engine dielectric support;

monitoring a first frame signal from the plurality of frame markers on the moving first print engine DSM;

monitoring a second frame signal from the plurality of frame markers on the moving second print engine DSM;

determining an offset for each of corresponding pairs of frames from the one or more image frames of the first print engine DSM and second print engine DSM based on the first frame signal and the second frame signal;

comparing the determined offset for corresponding pairs of frames to a target offset; and adjusting a velocity of the second print engine DSM based on the comparison of the determined offset and the target offset to maintain synchronization between the first and second print engines on a frame by frame basis.

2. The method of claim 1, wherein:

the first DSM comprises a first photoconductor; and the second DSM comprises a second photoconductor.

3. The method of claim 1, wherein monitoring the first frame signal from the moving first print engine DSM comprises monitoring a signal triggered by a DSM feature selected from the group consisting of one or more frame perforations, one or more frame marks, one or more frame holes; one or more frame reflective areas; and one or more frame diffuse areas.

4. The method of claim 1, wherein monitoring the second frame signal from the moving second print engine DSM comprises monitoring a signal triggered by a DSM feature selected from the group consisting of one or more frame perforations, one or more frame marks, one or more frame holes; one or more frame reflective areas; and one or more frame diffuse areas.

5. The method of claim 1, wherein enabling movement of the first print engine DSM comprises operating an AC motor.

6. The method of claim 1, wherein enabling movement of the second print engine DSM comprises operating a DC servo motor.

7. The method of claim 1, wherein the determined offset between each of corresponding pairs of frames comprises an offset time between the corresponding frames.

8. The method of claim 1, wherein the determined offset between each of corresponding pairs of frames comprises an offset distance between the corresponding frames.

9. The method of claim 1, wherein the target offset is be preset based on a nominal operating speed of a paper path between the first and second print engines multiplied by a known length of the paper path.

10. The method of claim 1, wherein the target offset is determined based on a calibration routine.

11. The method of claim 10, wherein the calibration routine comprises:

automatically determining a dwell time in a receiver sheet handling path between the first print engine and the second print engine; and determining the target offset based on the dwell time.

12. The method of claim 10, wherein the calibration routine comprises:

automatically measuring a transit time of a receiver sheet moving on a receiver sheet handling path between the first print engine and the second print engine; and determining the target offset based on the transit time.

13. The method of claim 1, wherein adjusting the velocity of the second print engine DSM comprises providing the difference between the determined offset and the target offset to a control loop.

14. The method of claim 13, wherein the control loop comprises a proportional plus integral control loop.

15. The method of claim 13, wherein the control loop comprises a proportional plus integral plus derivative control loop.

16. The method of claim 1, further comprising:

synchronizing a first splice seam on the first DSM with a second splice seam on the second DSM.

17. The method of claim 1, further comprising operating an image writer coupled to the second print engine to write based on a change in position of the second print engine DSM.

18. A method for synchronizing first and second print engines, comprising:

enabling movement of a second print engine DSM having a plurality of frame markers corresponding to a plurality of image frames;

monitoring a second splice signal to locate a splice seam on the second print engine DSM;

placing the located splice seam of the second print engine DSM in at least one known location;

enabling movement of a first print engine DSM having plurality of frame markers corresponding to a plurality of image frames;

monitoring a first splice signal to locate a splice seam on the first print engine DSM;

synchronizing the located splice seams from the first and second print engine DSM's separated by a target offset;

monitoring a first frame signal from the moving first print engine DSM;

monitoring a second frame signal from the moving second print engine DSM;

determining an offset for each of corresponding pairs of frames from the one or more image frames of the first print engine DSM and the second print engine DSM using the first frame signal and the second frame signal;

comparing the determined offset for each corresponding pair of frames to the target offset; and adjusting the velocity of the second print engine DSM based on the comparison of the determined offset and the target offset to maintain synchronization between the first and second print engines on a frame by frame basis.

19. The method of claim 18, wherein:

placing the located splice seam of the second print engine DSM in at least one known location comprises stopping the splice seam of the second print engine DSM in the at least one known location; and synchronizing the located splice seams from the first and second print engine DSM's separated by the target offset comprises restarting the second print engine DSM which is stopped in the at least one known location.

20. The method of claim 18, wherein:

placing the located splice seam of the second print engine DSM in at least one known location comprises tracking the splice seam of the second print engine DSM in multiple locations as it is moving.

21. The method of claim 18, wherein:

the target offset comprises a target offset time; and the determined offset comprises a determined offset time.

22. A method of increasing the throughput of a reproduction apparatus having a first print engine, comprising:

inserting a second print engine in-line with the first print engine and in-between the first print engine and a finishing device formerly coupled to the first print engine;

coupling a first splice signal and a first frame signal from the first print engine to a controller configured to operate the second print engine;

enabling movement of a second print engine DSM having a plurality of frame markers corresponding to a plurality of image frames;

monitoring a second splice signal to locate a splice seam on the second print engine DSM;

placing the located splice seam of the second print engine DSM in at least one known location;

enabling movement of a first print engine DSM having a plurality of frame markers corresponding to a plurality of image frames;

monitoring the first splice signal to locate a splice seam on the first print engine DSM;

synchronizing the located splice seams from the first and second print engine DSM's separated by a target offset;

monitoring the first frame signal from the plurality of frame markers on the moving first print engine DSM;

monitoring a second frame signal from the plurality of frame markers on the moving second print engine DSM;

determining an offset for corresponding pairs of frames from the one or more image frames of the first print engine DSM and the second print engine DSM using the first frame signal and the second frame signal;

comparing the determined offset for each corresponding pair of frames to the target offset; and adjusting the velocity of the second print engine DSM based on the comparison of the determined offset and the target offset to maintain synchronization between the first and second print engines on a frame by frame basis.

* * * * *